US005562462A

United States Patent [19]

Matsuba et al.

[11] Patent Number: 5,562,462

[45] Date of Patent: Oct. 8, 1996

[54] REDUCED CROSSTALK AND SHIELDED ADAPTER FOR MOUNTING AN INTEGRATED CHIP PACKAGE ON A CIRCUIT BOARD LIKE MEMBER

[76] Inventors: Stanley Matsuba, 5269 Waller Ave., Fremont, Calif. 94536; David Kim, 3492 Princess Margaret Ct., San Jose, Calif. 95132

[21] Appl. No.: 276,907

[22] Filed: Jul. 19, 1994

[51] Int. Cl.[6] ..... H01R 13/658

[52] U.S. Cl. ..... 439/70; 439/608; 439/937; 439/931

[58] Field of Search ..... 439/885, 937, 439/931, 608, 70, 74, 83; 206/701, 719, 722, 725

[56] References Cited

U.S. PATENT DOCUMENTS

| | | | |
|---|---|---|---|
| 2,963,775 | 12/1960 | Chadwick | 439/885 |
| 3,760,329 | 9/1973 | Stepan | 339/18 C |
| 4,442,938 | 4/1984 | Murphy | 206/329 |
| 4,753,003 | 6/1988 | Gobeil | 29/884 |
| 4,787,510 | 11/1988 | Powell | 206/329 |
| 4,878,851 | 11/1989 | Mullen, III | 439/83 |
| 4,894,031 | 1/1990 | Damon et al. | 439/885 |
| 4,913,286 | 4/1990 | Tate | 206/329 |
| 4,936,012 | 6/1990 | Shepherd | 29/845 |
| 4,965,227 | 10/1990 | Chang et al. | 437/207 |
| 4,985,989 | 1/1991 | Murphy | 29/829 |
| 5,038,467 | 8/1991 | Murphy | 29/845 |
| 5,088,930 | 2/1992 | Murphy | 439/70 |
| 5,118,298 | 6/1992 | Murphy | 439/68 |
| 5,151,039 | 9/1992 | Murphy | 439/70 |
| 5,168,432 | 12/1992 | Murphy et al. | 361/421 |
| 5,184,285 | 2/1993 | Murphy et al. | 361/421 |
| 5,287,617 | 2/1994 | Murphy | 29/741 |

*Primary Examiner*—Gary F. Paumen

*Attorney, Agent, or Firm*—Burns, Doane, Swecker & Mathis, L.L.P.

[57] ABSTRACT

An adapter for locating an integrated circuit having a plurality of pin-like elements extending therefrom which are adapted to be electrically interconnected with electrical contacts on a printed circuit board includes a plurality of generally cylindrical socket contact receiving members in each of which is located a socket contact for receiving one of the pin-like elements extending from the integrated circuit. The receiving members are spaced apart from one another so that a space exists between adjacent receiving members to allow inspection of the solder joints. The adjacent receiving members are connected to one another so that the plurality of receiving members form a single unit. The adapter can be used in connection with various types of integrated chip packages.

16 Claims, 8 Drawing Sheets

REDUCED CROSSTALK AND SHIELDED ADAPTER FOR MOUNTING AN INTEGRATED CHIP PACKAGE ON A CIRCUIT BOARD LIKE MEMBER

FIELD OF THE INVENTION

The present invention pertains to an adapter and a connector assembly for use in connection with circuit boards. More particularly, the present invention relates to an adapter for removably installing a multi-pin integrated chip on a circuit board, and a connector assembly for providing electrical interconnection between two printed circuit boards or the like.

BACKGROUND OF THE INVENTION

Multi-pin integrated chips, oftentimes referred to as a pin grid array (or dual in-line package or single in-line package), are typically mounted on a circuit board in a removable manner. In this way, the IC package can be removed and replaced as desired. In the past, this removable mounting of the IC package has been achieved through use of a socket adapter. The socket adapter includes a plurality of socket terminals which have ends that fit into holes in the circuit board to achieve a connection with electrical contacts on the circuit board. The terminal sockets are also adapted to removably receive the pins on the IC package to thereby result in an electrical connection between the circuitry on the integrated chip and the electrical contacts on the circuit board.

These types of adapters have gained some amount of acceptance in the industry as they provide a useful way of mounting integrated chips on a circuit board in a removable manner. However, these adapters are somewhat limiting in that with the through-hole components, only one side of the circuit board can be used for components. This, of course, means that up to fifty percent of the potential surface area on the circuit board is unavailable for use.

Socket adapters which employ through-hole technology have also been used in conjunction with printed circuit boards that incorporate surface mount components as a way of attempting to more fully utilize the available surface area of the printed circuit board. However, this alternative requires dual manufacturing methods—namely wave soldering to connect the through-hole components and solder reflow or hand soldering to connect the surface mount components.

Surface mount type socket adapters which are used for connecting IC packages to surface mount components on the circuit board are useful in that they allow both sides of the printed circuit board to be used. In these types of socket adapters, signals are carried via a circuit from the pins on the IC package to J type or gull wing leads attached to the edges of the socket adapter which are soldered to pads on the printed circuit board.

This surface mount type of adapter is typically much larger than the mating IC package since all of the signal lines must be distributed to the edges. Also, these adapters are typically a solid structure which raises concerns about the planarity of the adapter during the process of soldering the J type or gull wing lead connections. These adapters are also typically not designed to provide adequate air flow between the pin interstices to achieve efficient cooling and so concerns arise about heat dissipation and the potentially adverse effects of thermal expansion. Further, adapters of this type are not well suited for use with many IC packages having a high pin count because the solder joints of the interior pins are not readily accessible for inspection and rework.

As a general matter, many types of adapters are also not well suited for preventing electrical interference or crosstalk between adjacent signal connections. As the signal speed becomes higher and the signal connections located closer to one another, this interference or crosstalk becomes even more problematic. This concern with electrical interference or crosstalk also arises in other contexts such as, for example, when one printed circuit board (e.g., a daughter board) is mounted on another printed circuit board (e.g., a mother board) and in the case of fast clock speed or high speed data transition.

In view of the foregoing, it would be highly desirable to provide an adapter for a multi-pin component such as an IC package which addresses the foregoing concerns. In particular, it would be desirable to provide an adapter which, when used in connection with circuit boards having surface mount components, allows the solder joints to be inspected and, if necessary, reworked. Providing an adapter which allows significant air flow between the pin interstices and which is adapted to be used in conjunction with IC packages having a wide variety of pin arrangements would also be desirable. It would also be useful to provide an adapter that is well suited for preventing crosstalk or interference between adjacent signal connections.

SUMMARY OF THE INVENTION

In accordance with one aspect of the present invention, an adapter for removably positioning an IC package having a plurality of pins in relation to a printed circuit board having electrical contacts to achieve electrical interconnection between the pins of the IC package and the electrical contacts on the circuit board comprises a plurality of generally cylindrical socket contact receiving members in which is located a respective socket contact for removably receiving one of the pins of the IC package to establish an electrical connection between the socket contact and the pin. Each socket contact includes an extension which extends below a lower end of the respective socket contact receiving member for being brought into contacting engagement with an electrical contact on the printed circuit board so that the extension of the socket contact is positioned for being soldered at a solder joint to the electrical contacts on the circuit board. Connecting tabs are also provided for interconnecting adjacent socket contact receiving members. The adjacent socket contact receiving members are spaced from one another to define spaces between adjacent socket contact receiving members for allowing the solder joints to be viewed and, if necessary, reworked after the extension of the socket contact has been soldered to the electrical contacts on the circuit board.

In accordance with another aspect of the present invention, an adapter for locating an integrated circuit having a plurality of elements extending therefrom which are adapted to be electrically interconnected with electrical contacts on a printed circuit board comprises a plurality of elongated receiving members each having a hollow portion which is sized to receive a contact for establishing a connection with one of the elements of the integrated circuit. The receiving members are spaced apart from one another so that a space exists between the outer peripheral surfaces of adjacent receiving members. The adjacent receiving members are connected to one another so that the plurality of receiving members form a single unit of receiving members.

According to another aspect of the present invention, an adapter for removably positioning a ball grid array having a plurality of ball-shaped pins in relation to a printed circuit board having electrical contacts in order to achieve electrical interconnection between the ball-shaped pins and the electrical contacts on the printed circuit board comprises a plurality of generally cylindrical receiving members and a plurality of socket contacts which are each positioned in a respective one of the receiving members. The socket contacts include one portion which extends beyond a lower end of the respective receiving member for being connected to an electrical contact on the printed circuit board by way of a solder joint and an oppositely disposed portion which extends above an upper end of the respective receiving member to receive one of the ball-shaped pins. The portion of each socket contact which extends above the upper end of the respective receiving member is split to define two engaging arms which are movable from a first position in which the engaging arms are spaced apart to receive one of the ball-shaped pins to a second position in which the engaging arms contact the ball-shaped pin. Connecting tabs are also provided for interconnecting adjacent receiving members. The adjacent receiving members are spaced apart from one another to define spaces between adjacent receiving members for allowing the solder joints to be viewed and, if necessary, reworked after the socket contacts have been soldered to the electrical contacts on the circuit board.

In accordance with a further aspect of the present invention, a connector assembly for electrically interconnecting a first board member having electrical contacts thereon and a second board member having electrical traces thereon comprises two mounting members which are adapted to be mounted on the first board member in spaced apart relation to one another. Each of the mounting members includes at least one shielding portion and at least one contact element which is adapted to be electrically connected to the electrical contacts on the first board member. The mounting members are adapted to be mounted on the first board member with the contact elements connected to the electrical contacts on the first board member and with the contact elements spaced apart to receive the second board member therebetween so that the contact elements establish electrical contact with the electrical traces on the second board member to thereby provide an electrical interconnection between the electrical contacts on the first board member and the electrical traces on the second board member. The shielding portion of each mounting member is positioned with respect to the respective contact element to partially encircle the respective contact element. In a preferred embodiment, each of the shielding portions is provided with a grounded electrical plating that shields the respective contact element from other contact elements to thereby reduce crosstalk between contact elements.

BRIEF DESCRIPTION OF THE DRAWING FIGURES

The foregoing features of the present invention, as well as other additional features, will become more apparent from the detailed description set forth below considered in conjunction with the drawing figures in which like elements are designated by like reference numerals and wherein.

DETAILED DESCRIPTION OF THE INVENTION

Figure 1:
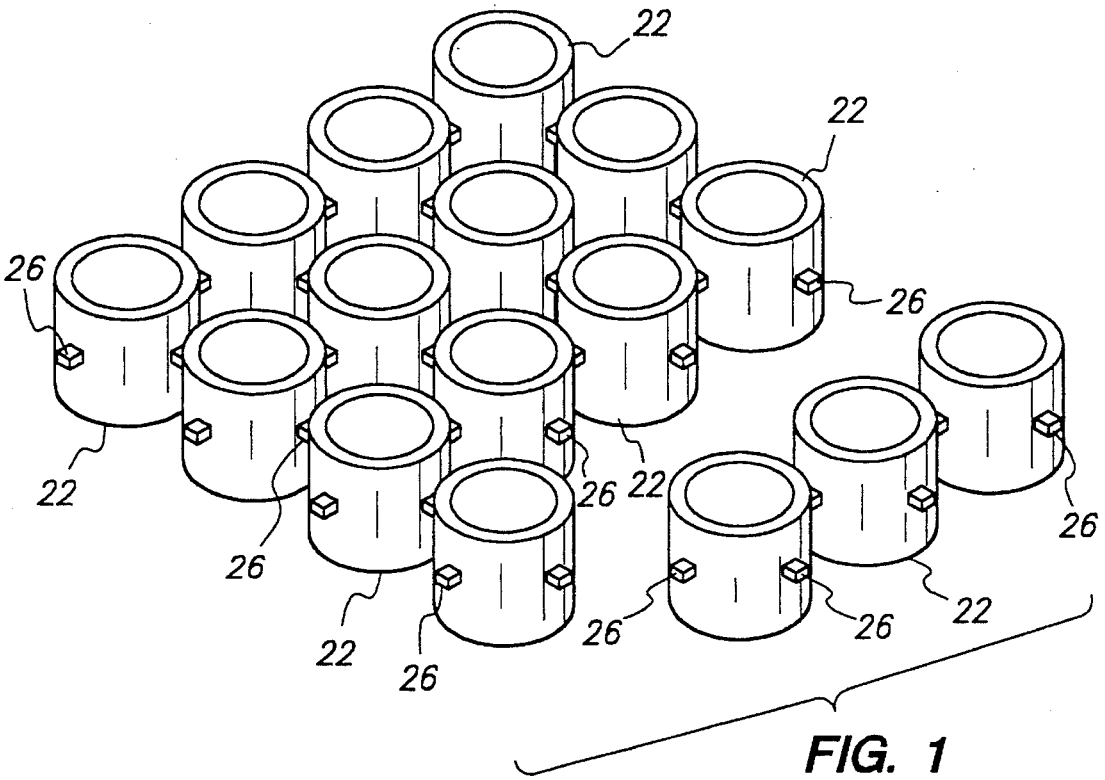
FIG. 1 is a top perspective view of an array of socket contact receiving members forming a part of the adapter according to one aspect of the present invention.
Figure 6:
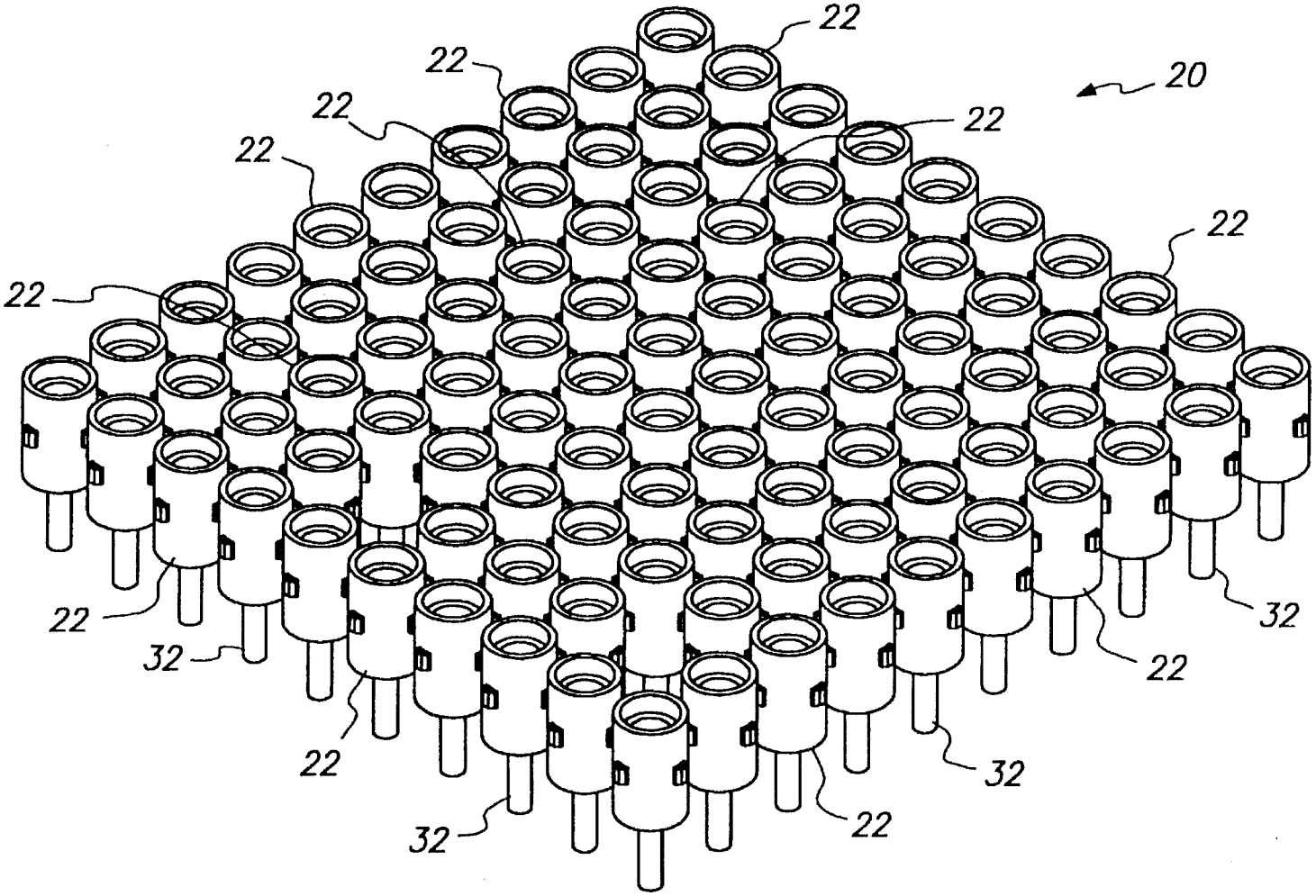
FIG. 6 is a top perspective view of an adapter according to one aspect of the present invention.

Referring initially to FIG. 6, an adapter 20 according to one aspect of the present invention for removably receiving an IC package includes an interconnected honeycomb-like array of socket contact receiving members 22. As seen in FIG. 1, each of the socket contact receiving members 22 is elongated and tubular, and possesses a generally cylindrical configuration. The socket contact receiving members 22 are hollow throughout their length and are positioned so that the longitudinal axes of all of the socket contact receiving members 22 are parallel to one another. Although the socket contact receiving members 22 are illustrated as being cylindrical, other shapes are certainly possible.

Preferably, the top surfaces of all of the socket contact receiving members forming the unit are disposed in a common plane. Likewise, the lower end surfaces of all of the socket contact receiving members are coplanar. Also, as illustrated in FIGS. 1, 2 and 6, the socket contact receiving members 22 are disposed in aligned rows and columns so that the center of each receiving member 22 in a given row (column) lies along a straight line with respect to a receiving member 22 in the immediately adjacent rows (columns).

Figure 2:
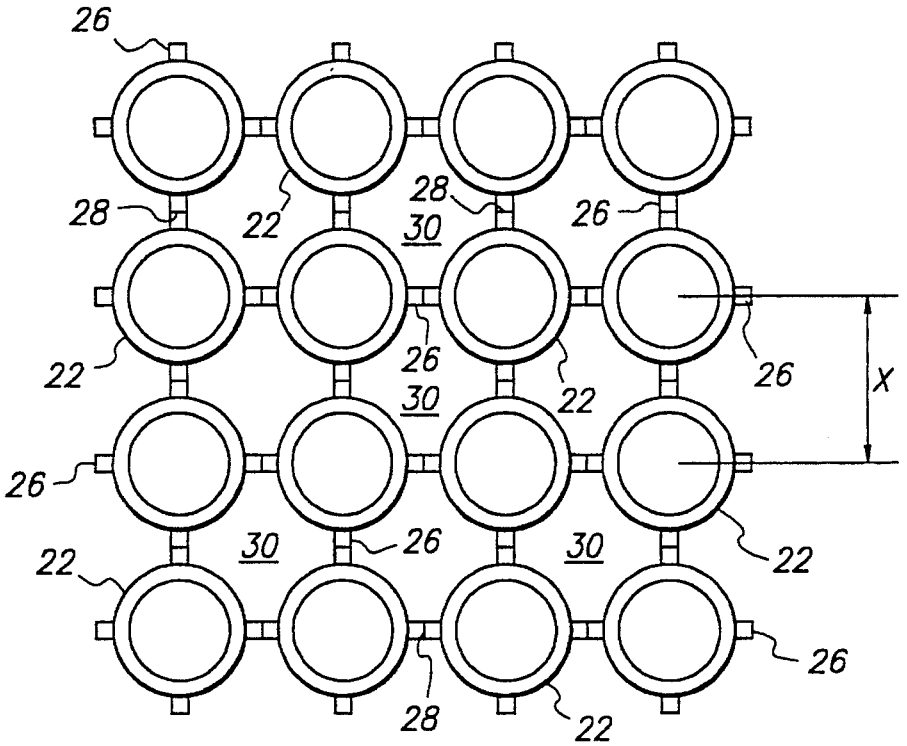
FIG. 2 is a top plan view of the array of socket contact receiving members illustrated in FIG. 1.

As can be seen with references to FIGS. 1 and 2, each of the socket contact receiving members 22 is provided with several connecting tabs 26. In the illustrated embodiment, each of the socket contact receiving members 22 is provided with four connecting tabs 26 positioned at ninety degree intervals around the outer peripheral surface of the socket contact receiving members 22. Although the connecting tabs 26 can extend over the entire or substantially the entire height of the respective socket contact receiving members 22, it is preferable that the connecting tabs 26 extend over only a short portion of the height of the respective socket contact receiving members 22. Also, the connecting tabs 26 are preferably located at an intermediate point between the upper and lower ends of the respective socket contact receiving members 22, preferably at the vertical midpoint.

The connecting tabs 26 on each socket contact receiving member 22 are connected to one of the connecting tabs 26 on the adjacent socket contact receiving member 22 along a connection line 28. As a result, the array of socket contact receiving members 22 form an integral single unit.

For reasons that will become more apparent from the discussion below, the socket contact receiving members 22 are designed to be individually separated from the other socket contact receiving members in the array. This is illustrated in FIG. 1 in which three of the socket contact receiving members 22 are illustrated as being detached from the remainder of the socket contact receiving members 22 forming the unit. FIG. 6 also illustrates two of the socket contact receiving members 22 being removed from the array.

The individual separability of the socket contact receiving members 22 can be achieved in various ways. For example, the connecting line 28 at which the connecting tabs 26 of the adjacent socket contact receiving members 22 are connected can be slightly weakened. Alternatively, the connecting tabs 26 can be designed to break at the connection between the socket contact receiving member 22 and the connecting tab 26.

As can be readily seen from FIG. 2, the individual socket contact receiving members 22 forming the array are positioned in spaced apart relation with respect to adjacent socket contact receiving members so that a space 30 exists between the outer peripheral surfaces of adjacent socket contact receiving members 22. In addition, since the interconnected connecting tabs 26 between the adjacent socket contact receiving members 22 extend along only a portion of the longitudinal extent of the cylindrical socket contact receiving members 22, spaces are provided both above and below the interconnected connecting tabs 26. The advantages associated with this spaced apart arrangement will become more apparent from the description below.

The socket contact receiving members 22 can be fabricated of any suitable material which will provide the desired dielectric properties. For example, the socket contact receiving members 52 can be molded from any polymeric, phenolic or ceramic material.

Figure 3:
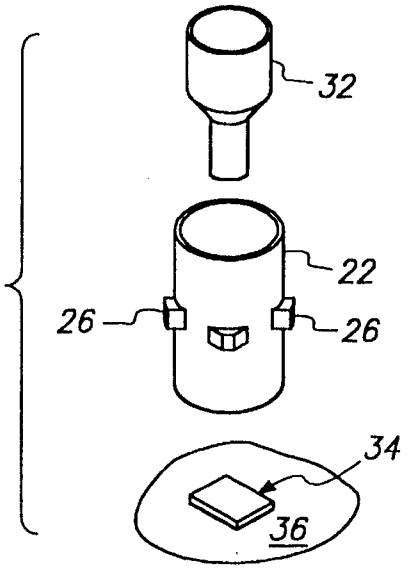
FIG. 3 is an exploded view of a single socket contact receiving member and a socket contact positioned above a contact pad located on a printed circuit board.

With reference to FIG. 3, each of the socket contact receiving members 22 is adapted to receive a socket contact 32 which in turn is adapted to removably receive one of the pins extending from the IC package. The socket contact 32 can be a standard commercial socket contact or a customized socket contact which is particularly adapted to receive a particular type of pin on an IC package. The socket contact receiving members 22 can be designed to tightly receive the socket contacts 32 in a press-fit manner to prevent relative movement between the two elements. In some instances, it may be desirable to configure and size the socket contact receiving members 22 in a way that allows the socket contact 32 to move in small increments within the respective socket contact receiving member 22.

As is known, the socket contact 32 can be provided with a lower cylindrical portion whose diameter is reduced with respect to the upper portion. When positioned within the socket contact receiving member 22, the smaller diameter lower portion of the socket contact 32 is adapted to extend beyond the lower end of the socket contact receiving member 22 for purposes of being soldered to a contact pad 34 disposed on a printed circuit board 36.

Figure 4:
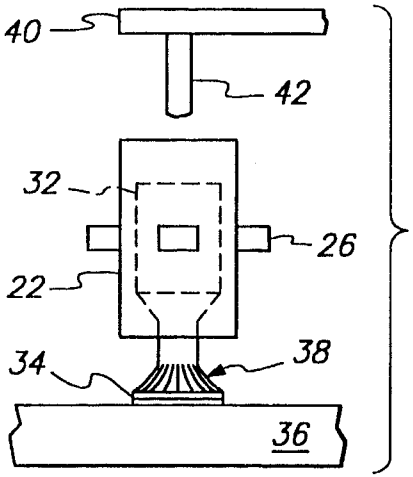
FIG. 4 is an exploded side view illustrating a portion of an adapter soldered to a printed circuit board and prepared to receive the pin of an IC package.

As seen in FIG. 4, the lower end of the socket contact 32 is soldered to the contact pad 34 on the printed circuit board 36 by way of a solder joint 38. The IC package 40 with one of the extending pins 42 is illustrated in position above one of the socket contact receiving members 22 prior to insertion of the pin 42 into the socket contact 32.

Figure 5:
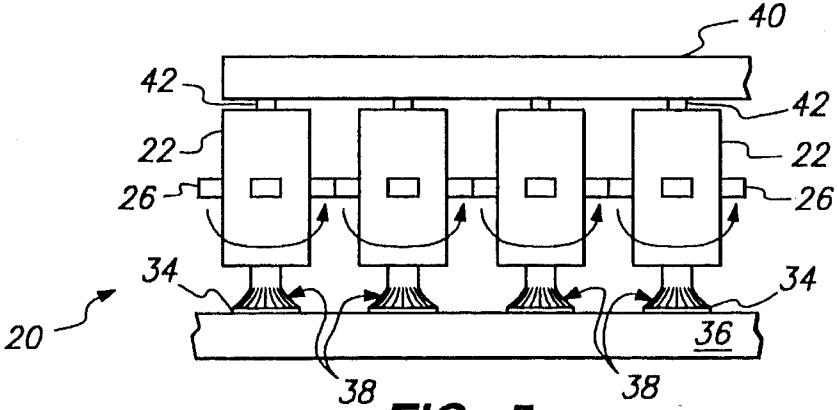
FIG. 5 is a side view of an adapter soldered to a printed circuit board with the IC package mounted on the adapter.

FIG. 5 illustrates the adapter 20 mounted on a printed circuit board 36 with a plurality of solder joints 38 connecting individual socket contacts 32 to contact pads 34 provided on the printed circuit board 36. In addition, the IC package 40 with a plurality of pins 42 is illustrated in its mounting position with respect to the adapter 20. Thus, by way of the socket contacts 32, an electrical connection is provided between the pins 42 extending from the IC package 40 and the contact pads 34 on the printed circuit board 36. This arrangement allows the IC package 40 to be removed from the adapter 20 when desired.

Figure 7:
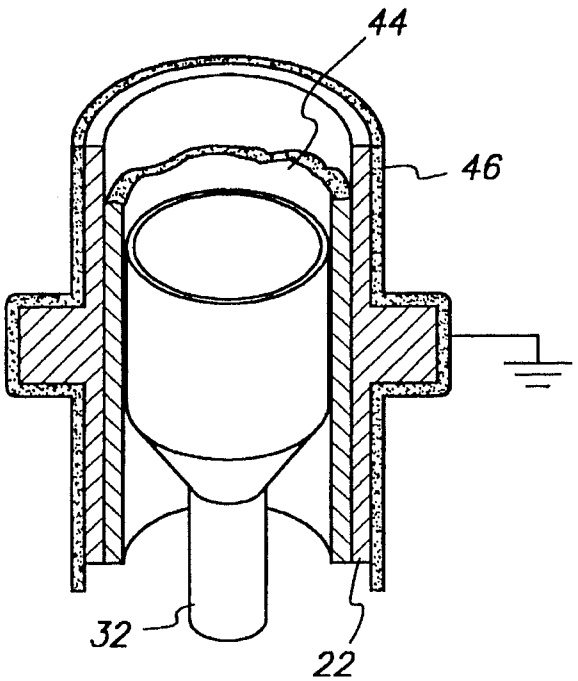
FIG. 7 is a cross-sectional side view of a single socket contact receiving member provided with a grounded electrical plating and having positioned therein a socket contact and a dielectric sleeve.

FIG. 7 illustrates one of the socket contact receiving members 22 with one of the socket contacts 32 received within the interior of the receiving member 22. Depending upon the requirements of a particular system, a cylindrical sleeve 44 which may be in the form of a dielectric sleeve is positioned within the interior of the receiving member 22. This sleeve 44 can be used as a way of adapting the socket contact receiving member 22 to receive differently sized socket contacts 32. This dielectric sleeve can also be used to change the impedance associated with the socket contacts 32. That is, in some applications such as when high speed signals are used, it may be useful to match as closely as possible the impedance of the pins on the IC package and the impedance associated with the socket contacts. The dielectric sleeve provides a mechanism for achieving that objective.

As further illustrated in FIG. 7, each of the socket contact receiving members 22 is provided with a grounded conductive metallic outer plating on its outer peripheral surface. This conductive plating can be in the form of a plating of copper, nickel, nickel over copper, gold, tin, etc. The plating can be provided with an extension that extends downwardly beyond the bottom of the socket contact receiving member 22 to ground the plating to a ground pad on the circuit board. The provision of a grounded conductive metallic plating is quite advantageous in that it creates a coax type configuration which shields adjacent signal connections from electrical interference or crosstalk. This allows signal connections to be placed much closer to one another and also allows the use of higher speed signals, both of which would otherwise result in potential problems with interference or crosstalk if the grounded conductive metallic plating 46 were not provided.

Preferably, the grounded conductive metallic plating also encases the connecting tabs 26. However, to avoid the possibility of grounding the signal itself, the top and bottom surfaces of the cylindrical socket contact receiving members 22 are not plated. In certain applications, it may be desirable to also provide plating on the inside surfaces of one or several socket contact receiving members 22 which are adapted to receive a ground pin on the IC package.

As mentioned above and illustrated in FIGS. 1, 2 and 6, the socket contact receiving members 22 forming the single integral unit are spaced apart from one another to define spaces 30 (see FIG. 2) between adjacent receiving members 22. Such an arrangement provides several advantages. First, once the socket contacts 32 have been soldered to the contact pads 34 on the printed circuit board 36, the spaces 30 between adjacent receiving members 22 allows the resulting solder joint to be inspected and, if necessary, reworked. This is a significant advantage over other known types of adapters in which inspection and possible reworking of the solder joint is either impossible or quite difficult.

As generally represented by the arrows in FIG. 5, the spaces 30 between adjacent receiving members 22 also allow for significant air flow which, from a standpoint of cooling and heat dissipation, is highly advantageous. Further, since the interconnected connecting tabs 26 extend only over a portion of the vertical extent of the cylindrical receiving members 22, significant air flow around the entire outer periphery of the adjacent receiving members 22 is possible.

The ability of the receiving members 22 forming the overall unit to be readily separated from one another provides the distinct advantage of allowing an infinite number of different arrays to be produced depending upon the needs of a particular system. That is, depending upon the pin configuration of a particular IC package, the honeycomb pattern defined by the interconnected receiving members can be appropriately adjusted. Thus, socket contact receiving members 22 can be removed from the outer edges of the array to provide a smaller size array, or socket contact receiving members 22 can be removed from the central portion of the array to provide an array in which the socket contact receiving members extend only along the periphery of the array. In addition, by simply varying the length of the connecting tabs 26, it is possible to easily adjust the spacing between adjacent socket contact receiving members 22, thereby imparting additional flexibility into the adapter.

Further, when the socket contact receiving members 22 are designed to allow relative movement with respect to the socket contacts 32, it is possible to accommodate any variations in the planarity of the printed circuit board or the honeycomb array of receiving members 22.

Figure 16:
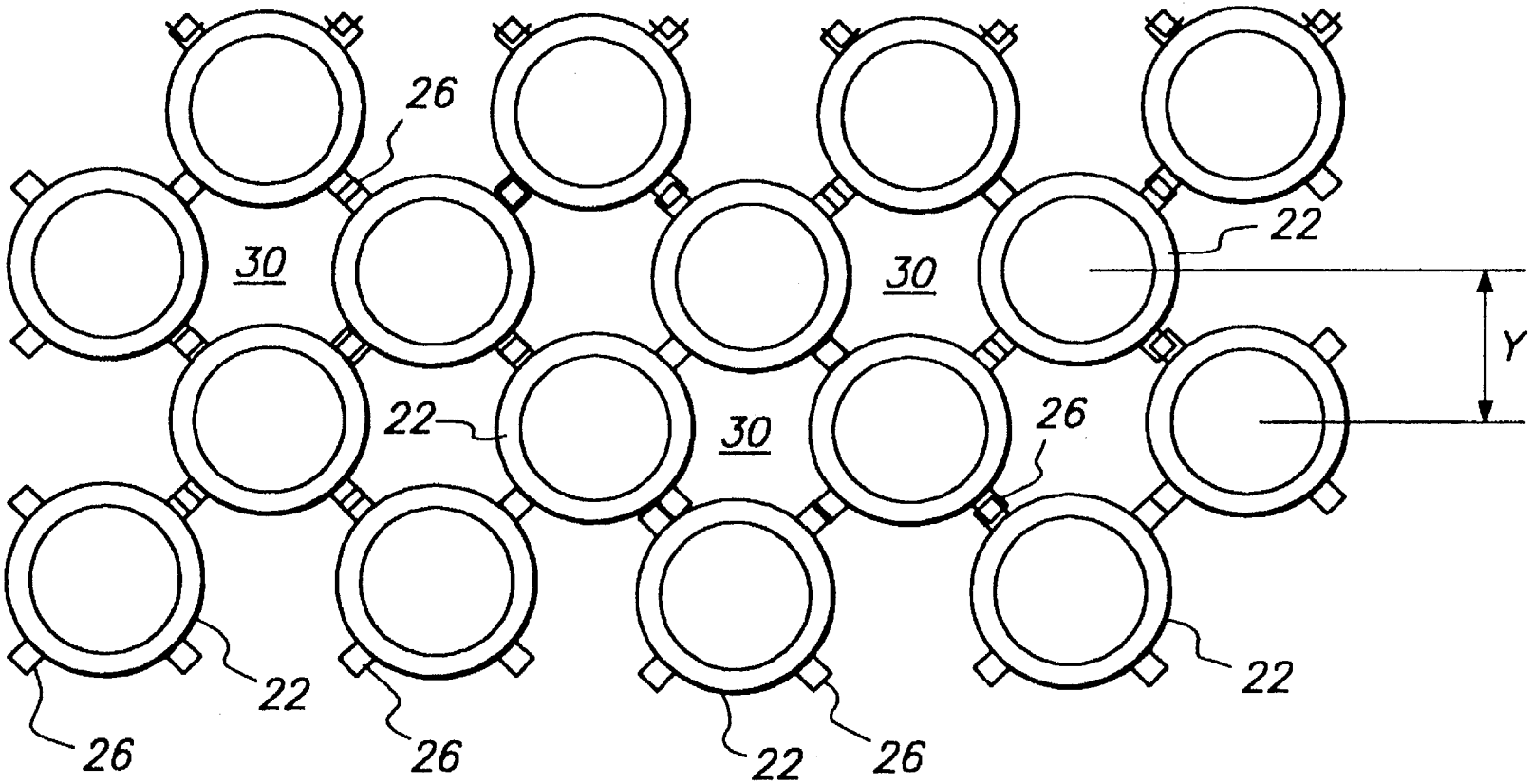
FIG. 16 is a top plan view of a different array of socket contact receiving members.

As an alternative to the aligned row and columnar arrangement of socket contact receiving members 22 illustrated in FIGS. 1, 2 and 6, the socket contact receiving members 22 can be arranged in the manner shown in FIG. 16. In this alternative arrangement, the array consists of adjacent rows (columns) of socket contact receiving members 22 which, instead of being aligned with one another, are offset relative to one another. That is, the receiving member 22 in any given row (column) is offset with respect to the receiving members in the immediately adjacent rows (columns).

The array of socket contact receiving members 22 illustrated in FIG. 16 provides certain advantages over the array depicted in FIGS. 1, 2 and 6 insofar as it permits the receiving members 22 to be positioned closer to one another. It has been found that the array illustrated in FIG. 16 allows the center-to-center spacing "y" between receiving members 22 to be about one-half the center-to-center spacing "x" between the receiving members 22 of the array shown in FIG. 1. It is to be noted that all of the other features associated with the adaptor described above are equally useful in conjunction with the array of socket contact receiving members 22 shown in FIG. 16.

In accordance with another aspect of the present invention illustrated in FIGS. 8–12, the useful characteristics associated with the adaptor of the present invention can also be applied to an adapter for use in electrically interconnecting a ball grid array to electrical contacts on a printed circuit board. In a ball grid array, ball-shaped pins are used in place of the cylindrical elongated pins used in the IC package described above.

Figure 8:
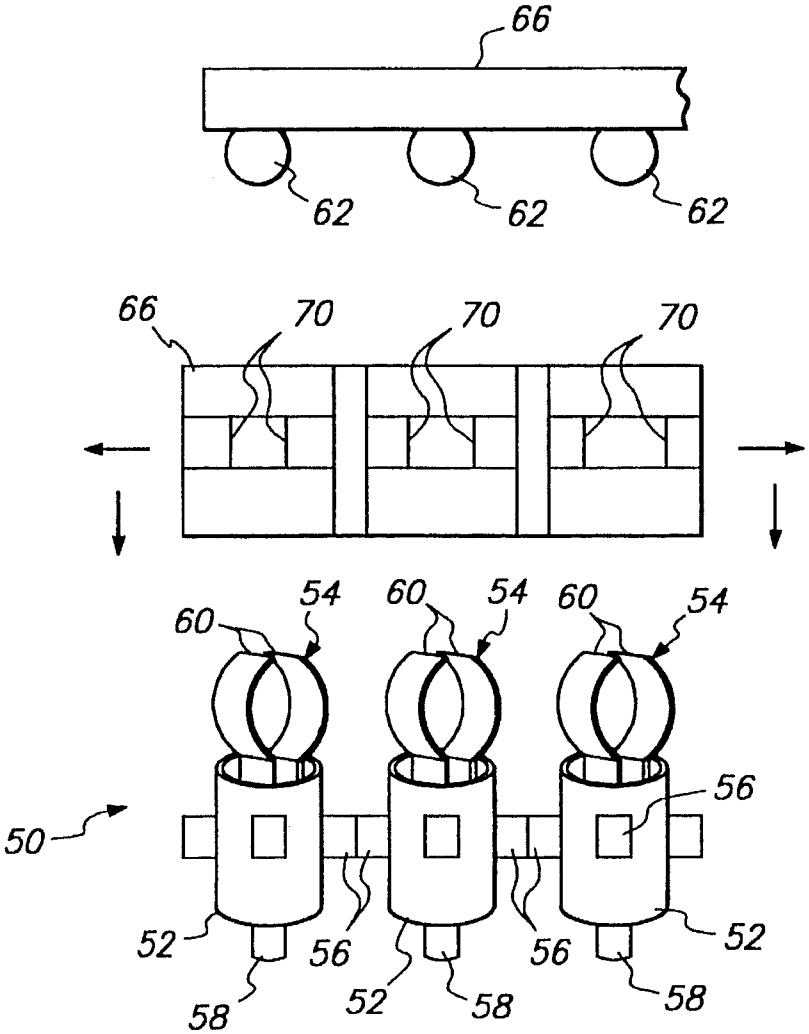
FIG. 8 is an exploded view of an adapter in accordance with another aspect of the present invention for use in connection with a ball grid array.

With reference initially to FIG. 8, the adapter 50 for use in conjunction with a ball grid array includes a plurality of generally cylindrical socket receiving members 52 which are each adapted to receive a socket contact 54. The socket contact receiving members 52 are disposed in a honeycomb-like array in a manner similar to that illustrated in FIG. 6, with adjacent socket contact receiving members 52 being interconnected by way of connecting tabs 56. The features and characteristics associated with the socket contact receiving members 52 and the manner in which they are spaced apart is similar to that described above with reference to the embodiment of the adapter illustrated in FIG. 6.

Figure 9:
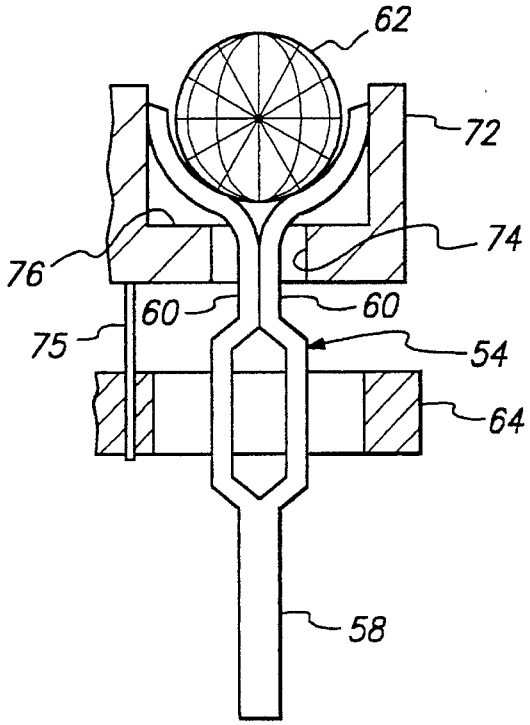
FIG. 9 is a cross-sectional side view of a portion of the adapter illustrated in FIG. 8 showing the arms in a position for receiving the ball-shaped pin of the ball grid array.
Figure 10:
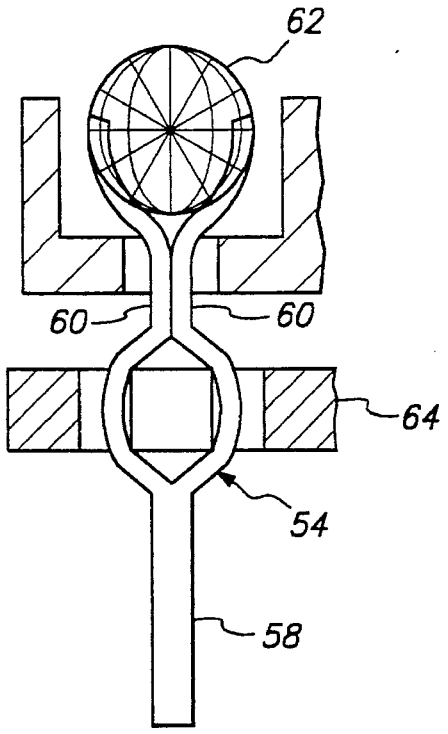
FIG. 10 is a cross-sectional side view similar to FIG. 9 illustrating the arms of the contact in a second position for closely contacting the ball-shaped pin of the ball grid array.

Each of the socket contacts 54 is comprised of a split tine as best seen in FIGS. 9 and 10. The split tine includes a lower end portion 58 that is adapted to be received in the socket contact receiving member 52 so that a portion extends beyond the lower end of the socket contact receiving member 52. For purposes of simplicity and ease in understanding, the socket contact receiving member 22 is not illustrated in FIGS. 9 and 10.

The lower end portion 58 of the split tine merges into two separate arms 60. The arms 60 are configured in a way that defines three different regions along the length of the arms. The portions of the arms located adjacent the lower portion 58 of the split tine are curved outwardly away from one another so as to be positioned in spaced apart relation, the portions of the arms 60 located at an intermediate location are positioned in abutting or substantially abutting relation to one another, and the portions of the arms 60 disposed at the upper end are once again curved outwardly away from one another. The upper ends of the arms 60 are adapted to receive the ball-shaped pin element 62 extending from the ball grid array to provide connection between the socket contact 54 and the ball-shaped pin element 62.

The lower portion 58 of the split tine is adapted to be brought into contacting engagement with a contact pad on a printed circuit board and appropriately soldered in place in a manner similar to that illustrated in FIGS. 4 and 5 so that, by way of the ball-shaped pin element 62 and the socket contact 54, an electrical connection is provided between the integrated circuit of the ball grid array 66 and the electrical contacts on the printed circuit board. It is to be noted that in connection with the illustration in FIG. 8, only a portion of the socket contacts 54 are illustrated for purposes of simplicity. That is, the intermediate and upper end portions of the arms 60 are not specifically depicted.

As illustrated in FIGS. 8, 9, and 10, the adapter also includes a cam attachment 64 which allows the upper ends of the arms 60 to be spread apart by a distance sufficient to readily receive the ball-shaped pin element 62 of the ball grid array 66. The cam attachment 64 includes a plurality of compartments defined by through-holes 68. Each of the compartments or through holes 64 individually receives one of the socket contacts 54. As seen in FIGS. 9 and 10, the cam attachment 64 is positioned along the portion of the socket contact 54 where the arms 60 are spaced apart from one another. Preferably, the cam attachment 64 is designed to rest on the top surfaces of the socket contact receiving members 52.

Figure 12:
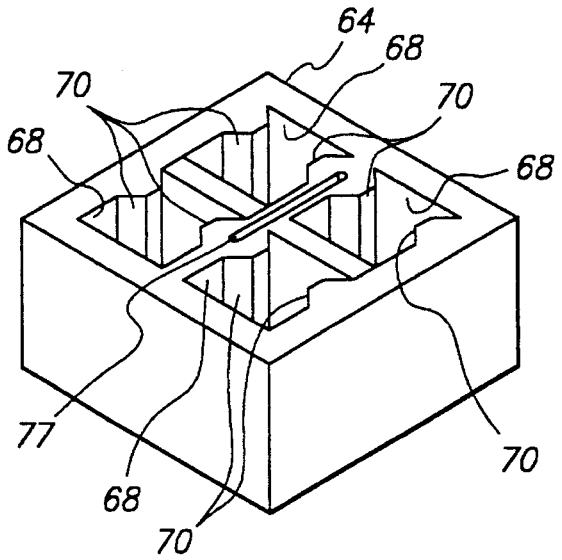
FIG. 12 is a top perspective view of a cam attachment for use in connection with the adapter illustrated in FIG. 8.

With reference to FIG. 12, each of the socket contact receiving holes 68 in the cam attachment 64 is provided with spaced apart and opposingly positioned cam elements 70. The cam attachment 64 is designed to be laterally movable between a first position and a second position. In the first position the spaced apart portions of the arms 60 are pinched between the cam elements 70. The camming action of the cam elements 70 forces the upper ends of the arm 60 to spread apart as illustrated in FIG. 9 for readily receiving one of the ball-shaped pin elements 62 on the ball grid array 66. On the other hand, when the cam attachment is laterally shifted to the second position to move the spaced apart portions of the arm 60 out of engagement with the cam elements 70, the upper portions of the arms 60 move back towards one another as illustrated in FIG. 10 to contact and tightly engage the ball-shaped pin element positioned between the upper ends of the arms 60.

It can be readily appreciated, therefore, that by simply laterally shifting the cam attachment 64 between the first and second positions, the upper ends of the arms 60 of all of the socket contacts 54 can be simultaneously moved between the two positions illustrated in FIGS. 9 and 10.

The cam attachment 64 illustrated in FIG. 12 is depicted as including four compartments or through-holes 68. It is to be understood, however, that the number of through-holes 68 will preferably be equal in number to the number of socket contacts 54 which will also preferably be equal to the number of socket contact receiving members 52 forming the honeycomb-like array.

The adapter illustrated in FIGS. 8–10 which is used in connection with the ball grid array can also include a contact housing 72 positioned above the cam attachment 64. The contact housing 72 includes a plurality of compartments provided with through-holes 74 for receiving the upper ends of the arms 60 of the socket contact 54. Axially recessed and radially inwardly directed ledges 76 can also be provided on the contact housing. The contact housing 72 serves as a type of enclosing structure for enclosing the upper ends of the arms 60 of the socket contact 54.

The contact housing 72 can also be provided with downwardly extending pins 75, one of which is shown in FIG. 9, for being received in elongated slots 77 (see FIG. 12) formed in the cam attachment 64 in order to properly locate the contact housing 72. The elongated slots 77 permit the cam attachment 64 to move relative to the contact housing 72. Although not illustrated, the contact housing 72 can be positioned in spaced apart relation above the cam attachment 64 by providing a bridge attachment between the contact housing and the socket contact 54.

Figure 11:
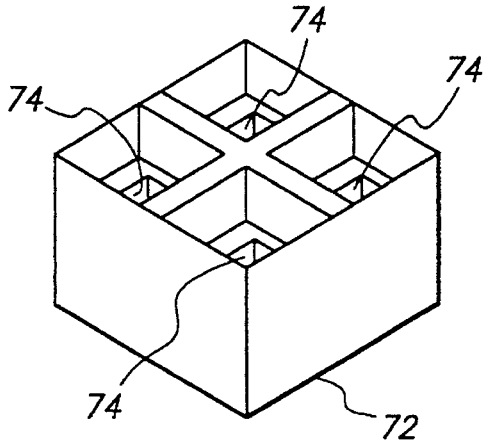
FIG. 11 is a top perspective view of a housing for use in connection with the adapter illustrated in FIG. 8.

As in the case of the cam attachment 64, the contact housing 72 illustrated in FIG. 11 is depicted as being comprised of four compartments which each individually receive one of the socket contacts 54. It is to be understood, however, that the number of compartments in the contact housing 72 will preferably correspond to the number of compartments or through-holes 68 in the cam attachment 64 as well as the number of socket contacts 54. If desired, this contact housing 72 need not be provided.

As mentioned above, the ball grid array adapter 50 illustrated in FIGS. 8–10 is designed so that the lower portion 58 of the socket contacts 54 are soldered at solder joints to the surface of the printed circuit board to provide connection with respect to the contact pads on the printed circuit boards. In use, each of the socket contact receiving members 52 receives one of the socket contacts 54 so that the socket contacts are positioned in a predetermined array. The lower ends 58 of the socket contacts 54 extending below the lower end of the socket contact receiving member 52 are then soldered to the printed circuit board to provide the necessary connection with the electrical contact pads on the printed circuit board.

The spaced apart relationship of the socket contact receiving members 52 forming the honeycomb-like array provides advantages similar to those mentioned above. That is, once the socket contacts 54 have been soldered in place, the spaces between adjacent socket contact receiving members 52 allows the solder joints to be inspected and, if necessary, reworked. Further, the spaces between adjacent socket contact receiving members 52 promote air flow between the socket contact receiving members 52 and the socket contacts 54, thereby permitting effective cooling and reducing heat dissipation problems that might otherwise arise.

Once the solder joints have been inspected and deemed acceptable, the cam attachment 64 can then be positioned above the socket contact receiving members 52. If used, the contact housing 72 can also be appropriately positioned with respect to the socket contacts 54. Thereafter, the cam attachment 64 is laterally moved to bring the cam elements 70 into engagement with the spaced apart portions of the arms 60 of the respective socket contacts 54, thereby forcing open the upper ends of the arms 60 to the extent necessary to receive the ball-shaped pin 62 of the ball grid array 66. Thereafter, the cam attachment 64 can be laterally shifted to move the cam elements 70 out of engagement with the spaced apart portions of the arms 60 of the respective socket contacts 54 so that the upper ends of the arms 60 contact and closely engage the ball-shaped pin elements as illustrated in FIG. 10. By laterally moving the cam attachment 64 back to the position in which the cam elements 70 engage the spaced apart portions of the arms 60 of the socket contact 54, the upper ends of the arms 60 can once again be spread apart to allow removal of the ball grid array 66.

It is to be understood that each of the socket contact receiving members 52 can also be provided with a grounded conductive metallic plating such as that illustrated in FIG. 7 to achieve the same advantageous results as mentioned above—namely the reduction or elimination of electrical interference or crosstalk between adjacent signal connections.

Further, an additional sleeve similar to that illustrated in FIG. 7 can be used in conjunction with the socket contact receiving members 52 to provide a variety of internal diameters for the socket contact receiving members so that differently sized socket contacts 54 can be positioned within the same socket contact receiving member 52.

As in the case of the adapter described above in connection with FIGS. 1–6, the material for the socket contact receiving members 52 can be selected of any desired material for achieving ideal dielectric properties. For example, the socket contact receiving members 52 can be molded from any polymeric, phenolic or ceramic material.

Figure 13:
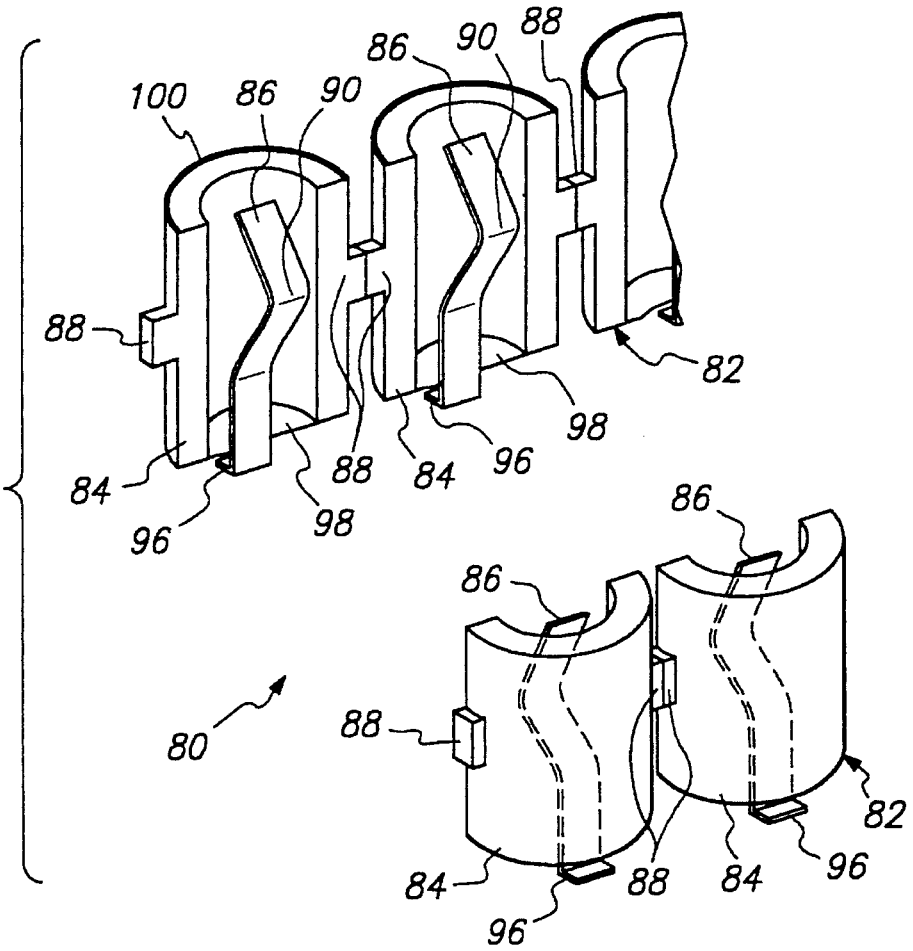
FIG. 13 is a top perspective view of a connector assembly in accordance with another aspect of the present invention for electrically interconnecting two circuit board like members.

In accordance with another aspect of the present invention, the advantages and beneficial results associated with the adapters described above can also be applied to a connector assembly for electrically interconnecting two printed circuit board-like members such as a mother board and daughter board. With reference initially to FIG. 13, the connector assembly 80 includes two mounting members 82.

Figure 14:
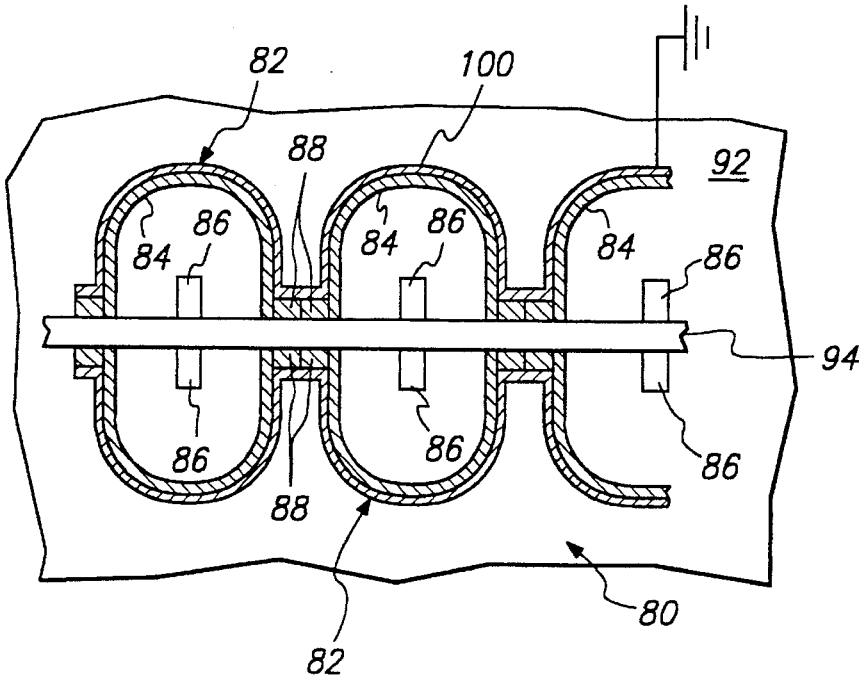
FIG. 14 is a top plan view of the connector assembly illustrated in FIG. 13 mounted on a printed circuit board like member and receiving another circuit board like member between the connector assembly's contacts.

Each of the mounting members 82 is comprised of a plurality of shielding portions 84 which each partially surround or encircle a contact element 86. As illustrated in FIGS. 13 and 14, each of the shielding portions 84 partially surrounds or encloses the contact element 86 along an arc of about 180 degrees.

Each of the shielding portions 84 is provided with connecting tabs 88 disposed on diametrically opposite sides. The connecting tabs 88 interconnect adjacent shielding portions 84 on each of the mounting members 82. As in the case of the adapters described above, the connecting tabs 88 preferably only extend along a portion of the vertical extent of the shielding portions 84 to provide spaces between adjacent shielding portions 84 both above and below the connecting tabs 88. The shielding portions 84 are designed to be separable from one another so that each of the mounting members 82 can be designed to have any number of shielding portions 84 and contact elements 86. Thus, the connections between adjacent shielding portions 84 are designed to be broken or otherwise severed.

The contact elements 86 are preferably secured to their respective surrounding shielding portions 84 in any suitable manner. For example, the shielding portions 84 can be provided with a solid base 98 that is outfitted with a hole through which extends the contact element 86. Other types of connecting structure can also be employed.

The individual contact elements 86 can be defined by a cantilevered spring-like element having a somewhat curved shape along its length. The curved configuration of the contact elements provides a generally convexly curved or somewhat pointed contact region 90 which is adapted to be brought into contacting engagement with electrical contacts on a printed circuit board (e.g., a daughter board).

As illustrated in FIG. 14, the two mounting members 82 defining the connector assembly 80 are adapted to be mounted in opposing and spaced apart relation with respect to a printed circuit board (e.g., mother board) 92. In that way, the contact elements 86 are also spaced apart from one another so that a circuit board (e.g., daughter board) can be received between the contact elements 86. FIG. 14 illustrates a circuit board positioned between the two mounting members 82.

The mounting members 82 can be spaced apart so that the contact areas 90 on opposing contact elements 86 are spaced apart by a distance slightly less than the thickness of the circuit board 94. In that way, when the circuit board 94 is inserted between the two mounting members 82, the contact areas 90 on the contact elements 86 are assured of being electrically connected to the electrical connections on the circuit board 94. The cantilever and spring-like nature of the contact elements 86 also allows the contact elements 86 to be biased away from one another when the circuit board 94 is inserted between the mounting members 82.

As illustrated in FIG. 13, the lower ends of the contact elements 86 are preferably bent to provide an enlarged area for soldering the contact elements 86 to the appropriate place on the printed circuit board 92. In addition, the bottom ends of the semi-cylindrical shielding portions 84 (or any other types of encirclements or shells) are preferably spaced above the bent lower ends 96 of the contact elements 86 as also illustrated in FIG. 13. Thus, when the mounting members 82 are positioned with respect to the printed circuit board 92 with the bent lower ends 96 of the contact elements 86 soldered to contact pads on the printed circuit board 92, the lower ends of the shielding portions 84 will be spaced above the top surface of the circuit board 92. That arrangement provides a space in which the soldered joint for the contact elements can be inspected and, if necessary, reworked. Such an arrangement also promotes air flow that contributes to cooling and heat dissipation.

As illustrated most clearly in FIG. 14, the outer surface of each mounting member is provided with a grounded conductive metallic plating 100. Thus, the metallic plating 100 extends along the outer peripheral surfaces of each of the semi-cylindrical shielding portions 84, as well as along the outer peripheral surface of each of the connecting tabs 88. As in the case of the adapters described above, the metallic plating is preferably not provided at the top and bottom end surfaces of the semi-cylindrical shielding portions 84.

The grounded conductive metallic plating 100 provides the advantageous function of shielding the respective contacts 86 from adjacent contacts to reduce crosstalk or electrical interference. That is, the way in which the contact elements 86 are partially surrounded and encircled by the shielding portions 84 coupled with the fact that the outer surface of the entire mounting member is provided with a grounded conductive plating results in a connector assembly that is not as susceptible to electrical interference as other types of connector assemblies.

Figure 15:
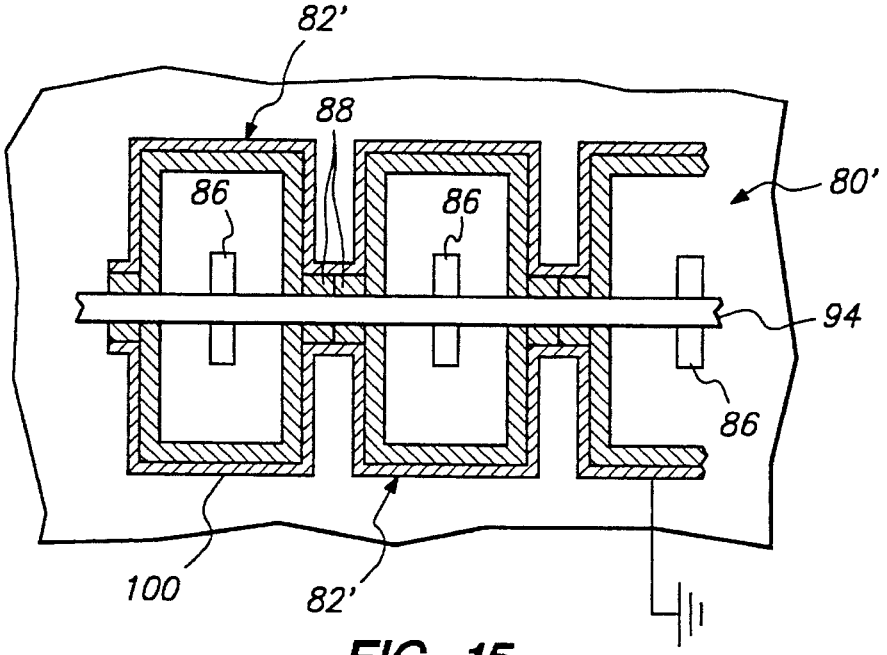
FIG. 15 is a top plan view of another embodiment of the connector assembly in accordance with the present invention.

FIG. 15 illustrates an alternative embodiment of the connector assembly 82' which is substantially identical to the embodiment illustrated in FIG. 4, except that the mounting members 82' each include a plurality of interconnected shielding portions 84' whose cross-sectional shape is different from that depicted in FIG. 14. In the embodiment shown in FIG. 15, rather than being semi-circular in cross-section, the mounting members 82' are semi-rectangular or semi-square in cross-section.

It is to be appreciated, therefore, that the connector assemblies 80, 80' illustrated in FIGS. 13–15 provide various advantages with respect to electrically interconnecting to printed circuit board-like members. The shielding which extends around the contact elements for an angular distance of approximately 180 degrees effectively shields respective contact elements from one another to prevent crosstalk or electrical interference that would otherwise arise in the absence of the grounded metallic plating applied to the shielding portions. Also, the way in which the shielding portions 84 are connected to one another allows for the production of strips of interconnected shielding portions of any desired length. By dividing the strip into smaller sections having the desired number of shielding portions, mounting members 82 can be produced which are usable in conjunction with any desired application.

FIGS. 14 and 15 illustrate the connector assembly 80, 80' in connection with the mounting of one printed circuit board, such as a daughter board, on another board, such as a mother board. It is to be understood, however, that the connector assembly and its advantageous shielding ability has other applications such as in connection with edge card connectors.

Although FIG. 13 illustrates the two mounting members 82 as being separate elements, it is to be understood that the two mounting members 82 which comprise the connector assembly 80 can be connected to one another so as to form a single unit. Additionally, although the embodiments of the adapters 20, 50 described above were described as being used in connection with surface mounted components on the printed circuit boards (i.e., soldered to surface mounted components) it is to be understood that advantages similar to those described above can also be realized by modifying the adapter for use in connection with through-hole technology.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. Adapter for removably positioning an integrated chip package having a plurality of pins in relation to a printed circuit board having electrical contacts in order to achieve electrical interconnection between the pins of the integrated chip package and the electrical contacts on the circuit board, comprising a plurality of generally cylindrical socket contact receiving members arranged in a plurality of rows and a plurality of columns, and in each of which is located a respective socket contact for removably receiving one of the pins of the integrated chip package to establish an electrical connection between the socket contact and the pin, each socket contact including a portion which extends below a lower end of the respective socket contact receiving member for being brought into contacting engagement with an electrical contact on the printed circuit board so that the socket contact is positioned for being soldered at a solder joint to the electrical contacts on the circuit board, and spaced apart connecting tabs interconnecting adjacent socket contact receiving members, the connecting tabs which connect a socket contact receiving member to adjacent socket contact receiving members in the same row lying in the same row as the row of socket contact receiving members, the connecting tabs which connect a socket contact receiving member to adjacent socket contact receiving members in the same column lying in the same column as the column of socket contact receiving members, adjacent socket contact receiving members being spaced from one another to define spaces between adjacent socket contact receiving members for allowing inspection of the solder joint.

2. Adapter according to claim 1, wherein at least some of said socket contact receiving members are provided with a groundable conductive outer plating for reducing electrical interference with respect to adjacently located pins.

3. Adapter for locating an integrated circuit having a plurality of elements extending therefrom which are adapted to be electrically interconnected with electrical contacts on a printed circuit board, comprising a plurality of elongated tubular receiving members arranged in a plurality of rows and a plurality of columns, the receiving members each having a hollow portion which is sized to receive one of the elements of the integrated circuit, each of the receiving members having an outer peripheral surface and the receiving members being spaced apart from one another so that a space exists between the outer peripheral surfaces of adjacent receiving members, the adjacent receiving members being connected to one another by spaced apart connecting tabs so that the plurality of receiving members form a single unit of receiving members, the connecting tabs which connect a socket contact receiving member to adjacent socket contact receiving members in the same row lying in the same row as the row of socket contact receiving members, the connecting tabs which connect a socket contact receiving member to adjacent socket contact receiving members in the same column lying in the same column as the column of socket contact receiving members.

4. Adapter according to claim 3, including a socket contact positioned within each receiving member for accepting one of the elements of the integrated circuit which are in the form of pin shaped elements, a portion of each socket contact extending beyond a lower end of the respective receiving member for being brought into contacting engagement with the electrical contacts on the printed circuit board.

5. Adapter according to claim 3, wherein adjacent receiving members are connected to one another by individual connecting tabs.

6. Adapter according to claim 5, wherein at least some of said receiving members are provided with a groundable conductive outer plating to reduce signal interference and crosstalk.

7. Adapter according to claim 3, wherein each receiving member is provided with a plurality of connecting tabs, the connecting tabs of each receiving member being connected to a connecting tab of an adjacent member along a connection line, said connection lines being breakable to remove a receiving member from the unit.

8. Adapter according to claim 3, including a socket contact positioned within each receiving member for accepting one of the elements of the integrated circuit which are in the form of ball-shaped elements, each socket contact including a split tine having spaced apart upper ends that are movable from a first position for receiving one of the ball-shaped elements of the integrated circuit to a second position in which the upper ends of the split tine receive and contact one of the ball-shaped elements of the integrated circuit.

9. Adapter according to claim 8, including a cam attachment provided with a plurality of through holes which are each adapted to receive one of the split tines, the cam attachment being movable relative to the split tines and being provided with a cam device associated with each through hole so that in a first portion of the cam attachment the upper ends of the split tine are located in the first position and in a second position of the cam attachment the cam devices engage a respective split tine to urge the upper ends of the split tine into the second position.

10. Adapter for removably positioning an integrated chip package having a plurality of pins in relation to a printed circuit board having electrical contacts in order to achieve electrical interconnection between the pins of the integrated chip package and the electrical contacts on the circuit board, comprising a plurality of generally cylindrical socket contact receiving members, in each of which is located a respective socket contact for removably receiving one of the pins of the integrated chip package to establish an electrical connection between the socket contact and the pin, each socket contact including a portion which extends below a lower end of the respective socket contact receiving member for being brought into contacting engagement with an electrical contact on the printed circuit board so that the socket contact is positioned for being soldered at a solder joint to the electrical contacts on the circuit board, and spaced apart connecting tabs interconnecting adjacent socket contact receiving members, adjacent socket contact receiving members being spaced from one another to define spaces between adjacent socket contact receiving members for allowing inspection of the solder joint, at least some of said socket contact receiving members being provided with a groundable conductive outer plating for reducing electrical interference with respect to adjacently located pins.

11. Adapter for locating an integrated circuit having a plurality of elements extending therefrom which are adapted to be electrically interconnected with electrical contacts on a printed circuit board, comprising a plurality of elongated tubular receiving members, the receiving members each having a hollow portion which is sized to receive one of the elements of the integrated circuit, each of the receiving members having an outer peripheral surface and the receiving members being spaced apart from one another so that a space exists between the outer peripheral surfaces of adjacent receiving members, the adjacent receiving members being connected to one another at spaced apart points so that the plurality of receiving members form a single unit of receiving members, at least some of said receiving members are provided with a groundable conductive outer plating to reduce signal interference and crosstalk.

12. Adapter according to claim 11, including a socket contact positioned within each receiving member for accepting one of the elements of the integrated circuit which are in the form of pin shaped elements, a portion of each socket contact extending beyond a lower end of the respective receiving member for being brought into contacting engagement with the electrical contacts on the printed circuit board.

13. Adapter according to claim 11, including a socket contact positioned within each receiving member for accepting one of the elements of the integrated circuit which are in the form of ball-shaped elements, each socket contact including a split tine having spaced apart upper ends that are movable from a first position for receiving one of the ball-shaped elements of the integrated circuit to a second position in which the upper ends of the split tine receive and contact one of the ball-shaped elements of the integrated circuit.

14. Adapter according to claim 13, including a cam attachment provided with a plurality of through holes which are each adapted to receive one of the split tines, the cam attachment being movable relative to the split tines and being provided with a cam device associated with each through hole so that in a first portion of the cam attachment the upper ends of the split tine are located in the first position and in a second position of the cam attachment the cam devices engage a respective split tine to urge the upper ends of the split tine into the second position.

15. Adapter for locating an integrated circuit having a plurality of elements extending therefrom which are adapted to be electrically interconnected with electrical contacts on a printed circuit board, comprising a plurality of elongated tubular receiving members, the receiving members each having a hollow portion which is sized to receive one of the elements of the integrated circuit, each of the receiving members having an outer peripheral surface and the receiving members being spaced apart from one another so that a space exists between the outer peripheral surfaces of adjacent receiving members, the adjacent receiving members being connected to one another by spaced apart connecting tabs so that the plurality of receiving members form a single unit of receiving members, at least some of said connecting tabs being provided with a portion that is weakened relative to other portions of the connecting tab to permit separation of a receiving member from other receiving members.

16. Adapter according to claim 15, wherein at least some of said receiving members are provided with a groundable conductive outer plating for reducing electrical interference with respect to adjacently located pins.

* * * * *